US005221496A

United States Patent [19]

Holland

[11] Patent Number: 5,221,496

[45] Date of Patent: * Jun. 22, 1993

[54] AQUEOUS PREWASH STAIN REMOVER COMPOSITIONS WITH EFFICACY ON TENACIOUS OILY STAINS

[75] Inventor: Richard J. Holland, Grosse Ile, Mich.

[73] Assignee: BASF Corp., Parsippany, N.J.

[ * ] Notice: The portion of the term of this patent subsequent to Feb. 16, 2010 has been disclaimed.

[21] Appl. No.: 892,095

[22] Filed: Jun. 2, 1992

[51] Int. Cl.[5] ..... C11D 1/72; C11D 3/30; C11D 3/33; C11D 17/08

[52] U.S. Cl. ..... 252/143; 252/153; 252/173; 252/174.21; 252/174.22; 252/546; 252/548; 252/DIG. 11; 252/DIG. 14; 252/DIG. 19; 8/137

[58] Field of Search ..... 252/118, 153, 142, 143, 252/173, 174.21, 174.22, 527, 529, 546, 548, DIG. 14, DIG. 19; 8/137

[56] References Cited

U.S. PATENT DOCUMENTS

| | | | |
|---|---|---|---|
| 3,915,633 | 10/1975 | Ramachandran | 8/137 |
| 4,290,904 | 9/1981 | Poper | 252/548 |
| 4,306,987 | 12/1981 | Kaneko | 252/99 |
| 4,537,705 | 8/1985 | Mahoney | 252/529 |
| 4,595,527 | 6/1986 | Gipp | 252/546 |
| 4,648,987 | 3/1987 | Smith et al. | 252/559 |
| 4,649,224 | 3/1987 | Panek et al. | 568/624 |
| 4,665,239 | 3/1987 | Panek et al. | 568/624 |
| 4,738,791 | 4/1988 | Ertle | 252/118 |
| 4,738,792 | 4/1988 | Ertle | 252/118 |
| 4,804,486 | 2/1989 | Day | 252/153 |
| 4,997,587 | 3/1991 | Baur | 252/102 |
| 5,019,296 | 5/1991 | Baur | 252/546 |
| 5,051,212 | 9/1991 | Culshaw | 252/546 |
| 5,082,599 | 1/1992 | Oftring | 252/546 |

*Primary Examiner*—Paul Lieberman
*Assistant Examiner*—Michael Tierney

[57] ABSTRACT

An aqueous laundry prewash stain remover composition has on a weight basis 0.1 to 20% of at least one chelating agent from the group of citric acid, tartaric acid, ethylene diamine tetracetic acid, isoserine diacetic acid and Beta-alanine diacetic acid; 0.1 to 40% of nonylphenol ethoxylate; 0.1 to 10% of propoxylated ethylenediamine known as N,N,N',N'-tetrakis (2-hydroxypropyl) ethylenediamine; 0.1 to 5% of alpha-olefin epoxide modified polyether thickener; with the remainder of the composition being water. The composition provides enhanced stain removal on both oil and waterborne stains on a variety of fabrics. These formulations are solvent free, freeze/thaw stable, and do not precipitate on standing at room temperature.

18 Claims, No Drawings

AQUEOUS PREWASH STAIN REMOVER COMPOSITIONS WITH EFFICACY ON TENACIOUS OILY STAINS

FIELD OF THE INVENTION

The present invention relates to laundry prewash stain removers, and more particularly, to an improved stain remover composition with efficacy on tenacious oily stains, in addition to water-borne stains.

BACKGROUND OF THE INVENTION

Laundry prewash stain removers, also known as prespotters, have been in use for several years now. Typically these compositions are available in liquid spray or semi-solid stick form. The consumer applies the stain remover to soiled garments before washing with laundry detergent.

While these pretreatment formulations have demonstrated increased efficacy in cleaning soiled areas over the use of more standard laundry formulations alone, these stain removers have not proved equally viable on all types of stains and fabrics. There are a few reasons why this is true. Current laundry prespotters are based on two mutually exclusive types of technology. Solvent based compositions were formulated to remove tenaceous greasy/oily stains from lipophilic fabric surfaces (polyester and blends of polyester). Aqueous based formulations were developed to remove water-borne stains including those sensitive to oxidation and enzymes.

There are two major reasons why a more universal, aqueous prespotter composition would be desirable. First, efficacy on a wide range of stain types would increase the chances that performance advantages are perceived by the consumer under actual use conditions. Second, environmental pressure on solvents in cleaning compositions has increased significantly in recent years. Regulation of volatile organic carbon (VOC) content in prewash stain removers is under consideration in California (see, e.g., California Regulation to Reduce Volatile Organic Emissions for Consumer Products: Round 1, May 13, 1991.) The trend is toward complete elimination of VOCs from cleaning products.

Unfortunately, the formulation of stable, aqueous based prewash stain removers that are also effective on stubborn oily soils is far from trivial. Certain emulsion type compositions based on nonionic surfactants are quite effective on dirty motor oil stains but are less efficacious on water-borne stains and soils (e.g., grass, grape juice, clay, etc.) The performance of these emulsion based compositions can be improved significantly if builders or chelants are incorporated in the formula. However, many of these chelants are water soluble salts which, when incorporated at desirable levels, cause the emulsion formulation to separate resulting in a heterogeneous, two phase mixture of limited utility.

Alternatively, a hydrotrope can be incorporated in the formula resulting in a clear, single phase composition. The addition of the hydrotrope, though solving the formula stability problem often results in a loss in performance on tenacious oily stains, specifically dirty motor oil. Of course, solvents could be incorporated into these formulations, but this could reduce their environmental acceptability.

Gipp, U.S. Pat. No. 4,595,527, relates to an aqueous laundry prespotter composition containing up to 6% of a chelating agent, a nonionic surfactant (or mixture) and water. The composition can further include up to 1% solvent and have a pH of 4.5 to 12.2. Formulations disclosed in Gipp containing higher levels of chelating agent(s) (~6%) were found to be unstable. That is, these compositions were found to separate into two phases when subjected to freeze/thaw stability studies. Attempts to stabilize the formulations of Gipp by incorporation of a hydrotrope resulted in compositions which were significantly less efficacious on oily stains, particularly dirty motor oil. Gipp also fails to disclose propoxylated ethylenediamine and an alpha-olefin epoxide modified polyether thickener as rheology modifiers to improve the stability of the emulsion based formulation.

Ramachandran, U.S. Pat. No. 3,915,633 relates a prewash stain remover composition containing 1 to 20% organic complexing agent, 0 to 30% surfactant and 99 to 50% water. This reference also does not teach the use of rheology modification agents to maintain formula stability while delivering water-borne and oily stain removal properties.

Additionally, thickened aqueous prespotter compositions have been disclosed by Smith et al., U.S. Pat. No. 4,648,987, as well as Ertle, U.S. Pat. Nos. 4,738,791 and 4,738,792.

There presently exists a need in the art for stable aqueous prewash stain removers based on nonionic surfactants, chelating agents and rheology modifiers which can be formulated to deliver outstanding performance on both oily and water-borne stains.

OBJECTS OF THE INVENTION

It is therefore an object of the present invention to provide an aqueous laundry prewash stain remover composition which is highly effective on both oil and water-borne stains.

Another object of the present invention is to provide aqueous prespotter compositions which are free of volatile organic carbon based solvents, but which are still extremely effective on dirty motor oil stains.

A further object of the present invention is to provide an aqueous, emulsion-type prespotter composition which has functional levels of chelating agent and nonionic surfactant which is stable for extended periods of storage.

SUMMARY OF THE INVENTION

These and other objects of the invention are achieved by providing an aqueous laundry prewash stain remover composition, which has on a weight basis from about 0.1 to about 20% of at least one of the chelating agents citric acid, tartaric acid, ethylene diamine tetracetic acid, isoserine diacetic acid and Beta-alanine diacetic acid (or the ester form of the heretofore acids). In addition, the composition according to the invention also includes from about 0.1 to about 40% of the nonionic surfactant nonylphenol ethoxylate. The composition further comprises two rheology control agents. The first of these is propoxylated ethylenediamine in an amount of from about 0.1 to about 10% of the formulation. Propoxylated ethylenediamine is also referred to as N,N,N',N'-tetrakis(2-hydroxypropyl)ethylenediamine. This compound is available from BASF Corp. under the trademark QUADROL ®. The second rheology control agent is from about 0.1 to about 5% of an alpha-olefin epoxide modified polyether thickener. It has now been found that the heretofore rheology modifiers measurably improve the stability of emulsion based formulations. The remainder of the composition is water. Unless otherwise specified, all components of the prewash stain remover composition according to all embodiments of the invention are set forth as weight percentages based on the total weight (100%) of the composition.

The novel composition according to the invention is stable for at least two freeze/thaw cycles, contains no solvent, and does not separate into phases at room temperature.

DETAILED DESCRIPTION OF THE PREFERRED EMBODIMENTS

The aqueous laundry prewash stain remover composition of the invention comprises at least one chelating agent, the nonionic surfactant nonylphenol ethoxylate, as well as the rheology control agents propoxylated ethylenediamine and alpha-olefin epoxide modified polyether thickener, and water.

The chelating agents are selected from the group consisting of citric acid, tartaric acid and ethylene diamine tetracetic acid. Of these, citric acid, isoserine diacetic acid and Beta-alanine diacetic acid are more preferred.

The composition of the invention also comprises nonyl phenol ethoxylate as a nonionic surfactant component. It is preferred that the nonylphenol ethoxylate have an average of about 6 moles of ethylene oxide per molecule.

The preferred polyether thickener for use with the novel composition is described in U.S. Pat. Nos. 4,649,224 and 4,665,239, which are incorporated herein by reference. These compounds are prepared by reacting a mixture of ethylene oxide and at least one lower alkylene oxide having about 3 to 4 carbon atoms in the presence of an active hydrogen-containing compound initiator and at least One alpha-olefin oxide having about 12 to about 18 Carbon atoms, preferably about 16 carbon atoms. Alternatively, capped copolymer polyether thickeners are prepared by first preparing a polyether by reacting ethylene oxide or ethylene oxide and at least one lower alkylene oxide having 3 to 4 carbon atoms in the presence of an active hydrogen-containing compound containing at least 2 active hydrogens and subsequently reacting the product obtained with an alpha-olefin oxide having about 12 to about 18, preferably about 16, carbon atoms. The (1) alpha-olefin oxide capped heteric and block copolymers of ethylene oxide and at least one lower alkylene oxide having 3 to 4 carbon atoms and (2) alpha-olefin oxide capped homopolymers of ethylene oxide are useful thickening agents in the composition of the invention. These polyether thickeners have molecular weights of from about 1000 to about 75,000, preferably from about 1000 to about 40,000, and most preferably about 17,000.

In one preferred embodiment of the invention, the prespotter composition has from 0.1 to about 10% of chelating agent(s), about 0.1 to about 20% of nonionic surfactant, from about 0.1 to about 5% of propoxylated ethylenediamine, from about 0.1 to about 3% of alpha-olefin epoxide modified polyether thickener, and water. Particularly preferred is about 6% of chelating agent(s), about 10% of nonylphenol ethoxylate, about 3% of propoxylated ethylenediamine, and about 2% of alpha-olefin epoxide modified polyether thickener, and the remainder being water.

An even more desirable embodiment would comprise about 6% of citric acid, about 10% of nonylphenol ethoxylate having about 6 moles of ethylene oxide, about 3% of propoxylated ethylenediamine, and about 2% of alpha-olefin epoxide modified polyether thickener, and the remainder being water.

In still another embodiment of the invention, the prespotter formulation will include from about 0.1 to about 20% of at least one of the chelating agents citric acid, tartaric acid and ethylenediamine tetracetic acid in combination with at least one of the chelating agents isoserine diacetic acid and Beta-alanine diacetic acid, as well as from about 0.1 to about 40% of nonylphenol ethoxylate, from about 0.1 to about 10% of propoxylated ethylenediamine, and from 0.1 to about 5% of alpha-olefin epoxide modified polyether thickener. Isoserine diacetic acid is available from BASF AG under the trademark TRILON® ES-9910. Beta-alanine diacetic acid is also available from BASF AG under the trademark TRILON® GS. The balance of the composition according to this embodiment will be water.

Another preferred embodiment of the aqueous composition according to the invention will have water and from about 0.1 to about 10% of the heretofore combination of chelating agents, about 0 1 to about 20% of nonionic surfactant nonylphenol ethoxylate, about 0.1 to about 5% of propoxylated ethylenediamine, and from about 0.1 to about 3% of alpha-olefin epoxide modified polyether thickener.

A more preferred embodiment will have from about 2 to about 5% of at least one of the chelating agents citric acid, tartaric acid and ethylene diamine tetracetic acid in combination with about 1 to about 3% of at least one of the chelating agents isoserine diacetic acid and Beta-alanine diacetic acid, about 0.1 to about 20% of nonionic surfactant nonylphenol ethoxylate, about 0.1 to about 5% of propoxylated ethylenediamine, and from about 0.1 to about 3% of alpha-olefin epoxide modified polyether thickener.

An even more preferred embodiment will have from about 2 to about 5% of citric acid in combination with about 1 to about 3% of isoserine diacetic acid or Beta-alanine diacetic acid, about 0.1 to about 20% of nonylphenol ethoxylate, about 0.1 to about 5% of propoxylated ethylenediamine and about 0.1 to about 3% of alpha-olefin modified polyether thickener.

An especially preferred embodiment will have about 3% of citric acid in combination with about 2% of isoserine diacetic acid or Beta-alanine diacetic acid, about 10% of the nonionic surfactant nonylphenol ethoxylate having about 6 moles of ethylene oxide (6 EO), about 3% of propoxylated ethylenediamine, and about 0.5% of alpha-olefin epoxide modified polyether thickener. Another especially preferred embodiment will comprise about 3% of citric acid, about 2% of isoserine diacetic acid or Beta-alanine diacetic acid, about 10% of nonylphenol ethoxylate having about 6 moles of ethylene oxide (6 EO), about 3% of propoxylated ethylenediamine, and about 1% of the heretofore polyether thickener.

The formulations of the invention may additionally include one or more additional nonionic surfactants, as well as one or more dyes, optical brighteners, perfumes and inert fillers in total amounts of up to about 10% of the composition.

The compositions according to the various embodiments of the invention will be stable for at least 2 freeze/thaw cycles, preferably at least about 3 cycles, and even more preferably for 5 cycles or more. As that term is used herein, one "freeze/thaw cycle" refers to freezing of the composition to approximately minus 5 degrees C. and then thawing of same to approximately 20 degrees C. within a 48 hour period. By "stability" it is meant that the composition shows no visual evidence of component precipitation or formula segregation. The compositions furthermore do not show evidence of precipitation when stored at room temperature (approximately 25 degrees C.).

The compositions of the invention may be made by charging a vessel with water, adding the chelating agents(s) and stirring the liquid until a clear solution is obtained. The nonylphenol ethoxylate surfactant is then added, and then the propoxylated ethylenediamine, and finally the associative thickener. Alternatively, the associative thickener may be mixed with the nonylphenol ethoxylate surfactant, and added along with the surfactant.

The formulations according to the various embodiments of the invention are emulsion type compositions with viscosities greater than about 100 centipoise (cp) as measured by a Brookfield viscometer at 25 degrees C. with spindle #2 at 60 r.p.m. Those skilled in the art may also discover that the compositions of the invention may also be formulated as pastes or as 37 stick" type prespotters by increasing the level of associative thickener in the formulation.

The pH of the compositions will range from about 3.0 to about 7.5, preferably from about 3.5 to about 6.0, and more preferably about 4.0 to about 5.0, especially 4.3.

The compositions of the invention are preferably dispensed from a "pump" type container well known in the art, or applied to fabric as a paste. Better performance is attained if about 200 milligrams of the composition is rubbed into the stain on the fabric, and the garment is laundered immediately. It has now also been found that the compositions according to their various embodiments are effective on dirty motor oil stains that are present on fabric for more than about 12 hours.

The following examples will illustrate the invention, but in no way should be construed as limiting the scope thereof:

PERFORMANCE STUDIES

Freeze/Thaw Stability

Five laundry prewash stain remover compositions were formulated. These are set forth in TABLE 1. Formula A is a composition according to a preferred embodiment of the present invention. Comparative formulas 1, 2, 3, and 4 are compositions disclosed in Gipp, U.S. Pat. No. 4,595,527. Comparative formula #1 forms a clear, single phase composition and comparative formulas 2, 3 and 4 form emulsions, when these compositions are subjected to freeze/thaw stability studies (successively freezing (−5 degrees C.) and thawing (20 degrees C.) the formula for up to five 48 hour cycles), evidence of precipitation was discovered in all four comparative formulas after only one freeze/-thaw cycle. In contrast, Formula A, within the scope of the invention, survived two cycles without an indication of component precipitation.

TABLE 1

PREWASH STAIN REMOVER COMPOSITIONS (ALL INGREDIENTS REPORTED AS PERCENT ACTIVE)

| COMPONENT | FORMULA A | COMPAR. #1 | COMPAR. #2* | COMPAR. #3* | COMPAR. #4 |
|---|---|---|---|---|---|
| CITRIC | 6.0 | — | — | — | — |
| SODIUM CITRATE | — | 6.0 | 6.0 | 6.0 | — |
| NONYLPHENOL ETHOXYLATE (6EO) | 10.0 | — | 10.0 | — | 10.0 |
| ETHOXYLATED ALCOHOL 8EO) | — | 7.0 | — | 7.0 | — |
| ETHOXYLATED ALCOHOL (3EO) | — | 3.0 | — | 3.0 | — |
| SODIUM NAPHTHALENE SULFONATE HYDROTROPE | — | 4.0 | — | — | 4.0 |
| SODIUM XYLENE SULFONATE HYDROTROPE | — | 2.0 | — | — | 2.0 |
| PROPOXYLATED ETHYLENE-DIAMINE | 3.0 | — | — | — | — |
| POLYETHER THICKENER@ | 2.0 | — | — | — | — |
| WATER | TO 100 | TO 100 | TO 100 | TO 100 | TO 100 |
| FREEZE/THAW STABILITY | STABLE FOR 2 CYCLES. | PRECIP-ITATES AFTER 1 CYCLE. | PRECIP-ITATES AFTER 1 CYCLE. | PRECIP-ITATES AFTER 1 CYCLE. | PRECIP-ITATES AFTER 1 CYCLE. |

*Disclosed in Gipp '527, column 10, lines 12-30; upper limit of chelant level.
@Molecular Weight about 17,000; Alpha-olefin oxide about 16 atoms.

The results compiled in Table 1 show that emulsion type formulations disclosed in Gipp '537 which contain the highest level of chelant (6%) and do not contain a hydrotrope (e.g. Comparative formula #'s 2, 3, and 4) are not stable when subjected to freeze/thaw stability studies. In contrast, a composition according to the present invention (Formula A) which includes the rheological control agents :(e.g. the propoxylated ethylenediamine and the polyether thickener) was found to be stable for longer periods of time. It is significant that this composition is also an emulsion type prespotter and does not include a hydrotrope.

Further stability studies were carried out with other formulations according to two additional embodiments of the present invention (Formulas B and C). Additional chelants were included in these compositions in addition to citric acid. Results of these studies are shown in TABLE 2.

TABLE 2

PREWASH STAIN REMOVER COMPOSITIONS (ALL INGREDIENTS REPORTED AS PERCENT ACTIVE)

| COMPONENT | FORMULA B | COMPAR. #5 | FORMULA C | COMPAR. #6 |
|---|---|---|---|---|
| CITRIC ACID | 3.0 | 3.0 | 3.0 | 3.0 |
| ISOSERINE DIACETATE* | 2.0 | 2.0 | — | — |
| β-ALANINE DIACETATE@ | — | — | 2.0 | 2.0 |
| NONYLPHENOL ETHOXYLATE (6EO) | 10.0 | 10.0 | 10.0 | 10.0 |
| PROPOXYLATED ETHYLENE-DIAMINE | 3.0 | — | 3.0 | — |
| POLYETHER THICKENER | 0.5 | — | 1.0 | — |
| WATER | TO 100 | TO 100 | TO 100 | TO 100 |
| FREEZE/THAW STABILITY | STABLE FOR 4 CYCLES. | PRECIP-ITATES AFTER 1 CYCLE. | STABLE FOR 5 CYCLES. | PRECIP-ITATES AFTER 1 CYCLE. |

*TRILON ® ES-9910 chelant from BASF AG.
@TRILON ® GS chelant from BASF AG.

The results compiled in Table 2 also show the advantages of incorporating the rheology modifiers (the propoxylated ethylenediamine and the polyether thickener) in these prespotter formulations. In both cases (Formulation B and C) freeze/thaw stability is improved by modifying the rheology of the composition.

Dirty Motor Oil Stain Removal

In this evaluation five clean dacron double knit fabrics (S-720 from Testfabrics, Middlesex, N.J.) and five clean D(65)/C(35) blend fabrics (S-7435, Testfabrics) were stained with dirty motor oil (DMO) obtained from the crankcase of a 1975 Ford Granada. Each polyester fabric was stained with two drops of DMO; each blend fabric was stained with one drop. The stains were allowed to wick overnight.

The reflectance ($Rd_1$) of each stained swatch is measured using a Hunter colorimeter and recorded. DMO stained swatches are then pretreated with 10 drops (200 mg.) of prewash stain remover and the swatch is rubbed together for 10 seconds to help loosen the stain. The fabrics are then washed in seventeen gallons of 100 degree F water (150 ppm hardness; 2:1 $Ca++/Mg++$) for 10 minutes in a General Electric washer using 85 grams of nonphosphate TIDE ® brand detergent. A regular rinse (2 minutes, 75 degrees F, 150 ppm hardness) follows the wash.

After drying the swatches for forty minutes in a Whirlpool Imperial dryer, the final reflectance ($Rd_2$) of each washed swatch is measured and recorded. Stain removal is determined as the difference between the washed ($Rd_2$) and the stained ($Rd_1$) fabric reflectance and is reported as the change in reflectance (Delta Rd).

Variations in the DMO stain removal test are carried out in which different fabric types (e.g. cotton, staple polyester, D(50)/C(50) blend etc.) are used. Other motor oil stains can also be used in these assessments to achieve similar results.

Experimental Results: DMO Stain Removal

A prewash stain remover according to one embodiment of the invention (formula B, TABLE 2) was formulated and its DMO stain removal performance was evaluated according to the procedure described above. For comparison a positive control (SHOUT ® brand aerosol prewash stain remover, a solvent based prespotter from S. C. Johnson) and a negative control (no prespotter) were included. Results of this assessment are shown in Table 3, below.

TABLE 3

DMO PRESPOTTER EVALUATIONS
100° F. WASH (10 min.; 150 ppm);
NP TIDE ® DETERGENT

| FORMULATION | CHANGE IN REFLECTANCE (DELTA Rd) DACRON DOUBLE KNIT (DDK) | D(65)/C(35) BLEND |
|---|---|---|
| FORMULA B | 51.6 (8.1) | 44.5 (1.1) |
| SHOUT ® AEROSOL | 37.4 (5.1) | 41.6 (1.6) |
| NO PRESPOTTER | 0.0 (0.0) | 4.0 (0.7) |

95% confidence intervals are in parenthesis.

These results demonstrate that detergent alone is not very effective at removing tenacious dirty motor oil stains from either polyester (dacron double knit) or polyester/cotton blend fabric. No stain removal was observed on polyester and only a 3 Rd unit improvement was obtained on blend. In contrast, the commercial, solvent based prespotter (SHOUT ® aerosol) is extremely effective on both fabrics. A preferred composition of the invention, formula B, gives equivalent performance to SHOUT ® aerosol on D(65)/C(35) blend and was found to be significantly better on DDK fabric by 14.2 Rd units. The performance advantages of Formula B are especially noteworthy because this composition contains no organic solvent.

An additional DMO stain removal study was carried out with Formula A (see TABLE 1). In this assessment Comparative Formula #4 was also evaluated. This composition incorporates two hydrotropes and is a clear, single phase formulation. A negative control (no prespotter) was also included in these experiments. Results are compiled in TABLE 4, below.

TABLE 4

DMO PRESPOTTER EVALUATIONS
100° F. (10 min.; 150 ppm);
NP TIDE ® DETERGENT

| FORMULATION | CHANGE IN REFLECTANCE (DELTA Rd) DACRON DOUBLE KNIT (DDK) | D(65)/C(35) BLEND |
|---|---|---|
| FORMULA A | 57.2 (4.4) | 46.6 (1.6) |
| COMPARATIVE FORMULA #4 | 0.9 (1.3) | 19.0 (1.2) |
| SHOUT ® AEROSOL | 46.4 (4.9) | 42.2 (1.7) |
| NO PRESPOTTER | 0.0 (0.0) | 4.0 (0.7) |

95% confidence intervals are in parenthesis.

The results shown in TABLE 4 indicate that Formula A, a solvent-free composition according to the invention, is actually superior to the solvent based commercial product (SHOUT ® aerosol) on both polyester (DDK) and polyester/cotton blend fabric. In contrast, the clear, single phase comparative formulation (#4) performed extremely poorly on DDK fabric and was also found to be inferior to SHOUT ® aerosol on polyester/cotton blend by 23.2 Rd units.

Multi-Stain Prespotter Test

Prewash stain remover performance on some water borne stains was evaluated using six fabric/stain combinations supplied by Scientific Services, Middlesex, N.J.: sebum soiled cotton, sebum soiled (D(65)/C(35) blend, clay/cotton, grass/cotton, chocolate fudge pudding/-blend and grape juice/blend. These assessments were carried out under the same conditions used in the DMO prespotter test (10 minute 100 degree F. wash with 150 ppm hardness water) except that 72 grams of Classic PUREX ® detergent was used instead of NP TIDE ® powder and 10 drops of prewash stain remover was added to each swatch (without rubbing) before washing. A Whirlpool IMPERIAL ® clothes washer was utilized in place of the General Electric washer utilized in the DMO test.

The stain removal performance of two compositions of the invention, Formula A (TABLE 1) and Formula B (TABLE 2) was compared to the performance of a clear, water based composition (Comparative Formula #1, TABLE 1) and two controls (the solvent based SHOUT ® aerosol and no prespotter). Results of these studies are shown in TABLE 5 below, along with the 95% confidence limits for each test swatch used.

TABLE 5

MULTISTAIN PRESPOTTER EVALUATIONS: 100° F. WASH (10 min., 150 ppm)
CLASSIC PUREX ® DETERGENT

| FORMULA | SEBUM/ | SEBUM/ | CLAY/ | GRASS/ | PUDDING | GRAPE |
|---|---|---|---|---|---|---|
| FORMULA A | 23.8 (1.0) | 34.3 (0.1) | 16.6 (2.3) | 14.9 (0.8) | 46.8 (0.3) | 27.0 (0.8) |
| COMPAR. FORMULA #1 | 23.2 (1.4) | 33.5 (0.4) | 16.0 (1.8) | 14.9 (0.8) | 47.0 (1.0) | 29.3 (0.6) |
| FORMULA B | 25.4 (1.8) | 33.6 (0.4) | 13.7 (1.7) | 15.7 (0.4) | 46.4 (0.9) | 28.3 (0.9) |
| SHOUT ® AEROSOL | 21.2 (1.2) | 31.5 (3.4) | 13.3 (1.5) | 14.4 (0.6) | 44.9 (0.9) | 22.4 (0.7) |
| NO PRE-SPOTTER | 11.9 (1.4) | 21.4 (0.6) | 14.4 (1.6) | 7.8 (0.6) | 44.8 (0.6) | 22.4 (0.7) |

95% Confidence intervals are in parenthesis.

These results show that all of the prespotter compositions tested significantly (95% confidence) improve stain removal on all fabric/stain combinations except clay soiled cotton. However, the improvements observed with compositions of the invention (Formulas A and B) on water borne stains (grass, pudding and grape juice) are greater than those obtained with the commercial solvent based prespotter (SHOUT ® aerosol). These advantages are more evident if the data is reported as the improvement in reflectance over that observed with no prespotter (see TABLE 6).

TABLE 6

MULTISTAIN PRESPOTTER EVALUATIONS, TABLE 5:
STATISTICALLY SIGNIFICANT ADVANTAGES
OVER NO PRESPOTTER (Rd UNITS)

| FORMULA | SEBUM/ COTTON | SEBUM/ COTTON | GRASS/ COTTON | PUDDING/ BLEND | GRAPE JUICE/ BLEND |
|---|---|---|---|---|---|
| FORMULA A | 11.9 | 12.8 | 7.1 | 2.0 | 4.6 |
| FORMULA B | 13.5 | 12.2 | 7.9 | 1.6 | 5.9 |
| COMPAR. #1 | 11.3 | 12.1 | 9.4 | 2.2 | 6.9 |
| SHOUT ® AEROSOL | 9.3 | 10.1 | 6.6 | NOT SIGNIF. | 2.7 |

The reflectance values reported in the table are improvements over no prespotter. The improvements cited are significant at the 95% confidence level.

The prewash stain remover compositions according to the various embodiments of the invention (Formulas A and B) substantially improve stain removal over no prespotter. The magnitude of these improvements is consumer perceivable (5 Rd units or greater) in many cases and clearly greater than that observed with the commercial solvent based prespotter (SHOUT ® aerosol). Moreover, the compositions as part of the invention were also found to be significantly better than SHOUT ® aerosol on many water based stains. Formula A is superior (95% confidence) on pudding/blend and grape juice/blend, while Formula B is superior (95% confidence) on grass/cotton and grape juice/-blend.

While the invention has been described in each of its various embodiments, it is to be understood that certain modifications may be made by those skilled in the art without departing form the true spirit and scope of the invention as set forth in the specification and the accompanying claims.

What is claimed is:

1. An aqueous laundry prewash stain remover comprising on a weight basis:

(a) from about 0.1 to about 20% of at least one chelating agent selected from the group consisting of citric acid, tartaric acid, ethylenediamine tetracetic acid, isoserine diacetic acid and Beta-alanine diacetic acid;

(b) from about 0.1 to about 40% of the nonionic surfactant nonylphenol ethoxylate:

(c) from about 0.1 to about 10% of propoxylated ethylenediamine known as N,N,N',N'-tetrakis(2-hydroxypropyl) ethylenediamine;

(d) from about 0.1 to about 5% of alpha-olefin epoxide modified polyether thickener; and (e) water.

2. The composition as claimed in claim 1, comprising:

(a) from about 0.1 to about 10% of at least one chelating agent selected from the group consisting of citric acid, tartaric acid, ethylene diamine tetracetic acid, isoserine diacetic acid and Beta-alanine diacetic acid;

(b) from about 0.1 to about 20% of the nonionic surfactant nonylphenol ethoxylate;

(c) from about 0.1 to about 5% of propoxylated ethylenediamine;

(d) from about 0.1 to about 3% of an alpha-olefin epoxide modified polyether thickener; and (e) water.

3. The composition as claimed in claim 2, comprising:

(a) about 6% of at least one chelating agent selected from the group consisting of citric acid, tartaric acid, ethylene diamine tetracetic acid, isoserine diacetic acid and Beta-alanine diacetic acid;

(b) about 10% of the nonionic surfactant nonylphenol ethoxylate;

(c) about 3% of propoxylated ethylenediamine;

(d) about 2% of an alpha-olefin epoxide modified polyether thickener; and (e) water.

4. The composition as claimed in claim 3, wherein said chelating agent is selected from the group consisting of citric acid, tartaric acid, and ethylene diamine tetracetic acid.

5. The composition as claimed in claim 4, wherein said chelating agent is citric acid.

6. The composition as claimed in claim 5, wherein said nonylphenol ethoxylate has an average of about 6 moles of ethylene oxide per molecule.

7. An aqueous laundry prewash stain remover composition, comprising on a weight basis:

(a) from about 0.1 to about 20% of at least one of the chelating agents citric acid, ethylene diamine tetracetic acid and tartaric acid in combination with at least one of the chelating agents isoserine diacetic acid and Beta-alanine diacetic acid;

(b) from about 0.1 to about 40% of nonylphenol ethoxylate;

(c) from about 0.1 to about 10% of propoxylated ethylenediamine known as N,N,N',N'-tetrakis(2-hydroxypropyl) ethylenediamine;

(d) from about 0.1 to about 5% of alpha-olefin epoxide modified polyether thickener; and (e) water.

8. The composition as claimed in claim 7, comprising:

(a) about 0.1 to about 10% of chelating agents;

(b) about 0.1 to about 20% of nonylphenol ethoxylate;

(c) about 0.1 to about 5% of propoxylated ethylene diamine;

(d) about 0.1 to about 3% of alpha-olefin epoxide polyether thickener; and (e) water.

9. The composition as claimed in claim 8, comprising:

(a) from about 2 to about 5% of at least one of the chelating agents selected from the group consisting of citric acid, tartaric acid, and ethylenediamine tetracetic acid in combination with about 1 to about 3% of at least one of the chelating agents selected from the group consisting of isoserine diacetic acid and Beta-alanine diacetic acid.

10. The composition as claimed in claim 9, comprising:

(a) from about 2 to about 5% of citric acid in combination with from about 1 to about 3% of isoserine diacetic acid or Beta-alanine diacetic acid.

11. The composition as claimed in claim 10, comprising:

(a) about 3% of citric acid and about 2% of isoserine diacetic acid or Beta-alanine diacetic acid.

12. The composition as claimed in claim 10, comprising:

(a) about 3% of citric acid and about 2% of isoserine diacetate.

13. The composition as claimed in claim 10, comprising:

(a) about 3% of citric acid and about 2% of Beta-alanine diacetic acid.

14. The composition as claimed in claim 10, comprising:

(a) about 10% of the nonionic surfactant nonylphenol ethoxylate.

(c) about 3% of propoxylated ethylenediamine; and (d) about 0.5 to about 1% of alpha-olefin epoxide modified polyether thickener.

15. The composition as claimed in claim 14, comprising:

(b) about 10% of nonylphenol ethoxylate having 6 moles of ethylene oxide (6 EO);

(c) about 3% of propoxylated ethylenediamine; and (d) about 0.5 to about 1% of alpha-olefin modified polyether thickener.

16. The composition as claimed in claim 15, wherein said composition has a freeze/thaw stability of at least about 2 cycles.

17. The composition as claimed in claim 15, wherein said composition has a freeze/thaw stability of at least about 3 cycles.

18. The composition as claimed in claim 15, wherein said composition has a freeze/thaw stability of at least about 5 cycles.

* * * * *